US008347858B2

(12) United States Patent
Shimamura et al.

(10) Patent No.: US 8,347,858 B2
(45) Date of Patent: Jan. 8, 2013

(54) LOAD CONDITION DETECTION APPARATUS FOR GENERAL-PURPOSE ENGINE

(75) Inventors: Hideaki Shimamura, Wako (JP); Takao Tamechika, Wako (JP); Atsuhisa Ishikawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 457 days.

(21) Appl. No.: 12/763,759

(22) Filed: Apr. 20, 2010

(65) Prior Publication Data

US 2010/0269786 A1 Oct. 28, 2010

(30) Foreign Application Priority Data

Apr. 27, 2009 (JP) ..... 2009-107979

(51) Int. Cl.
*F02D 41/02* (2006.01)
*F02D 41/00* (2006.01)

(52) U.S. Cl. ..... 123/350; 123/333; 701/54

(58) Field of Classification Search ..... 123/350, 123/332, 333, 198 D; 701/54, 110; 73/114.04, 73/862.69
See application file for complete search history.

(56) References Cited

U.S. PATENT DOCUMENTS 5,301,546 A * 4/1994 Inada et al. ..... 73/114.04
2005/0071066 A1 * 3/2005 Rose et al. ..... 701/54

FOREIGN PATENT DOCUMENTS

JP 2003-278581 A 10/2003
JP 2005-299519 A 10/2005

OTHER PUBLICATIONS

European Search Report dated Aug. 2, 2010, issued in corresponding European Patent Application No. 10160853.7.

* cited by examiner

*Primary Examiner* — Mahmoud Gimie
(74) *Attorney, Agent, or Firm* — Westerman, Hattori, Daniels & Adrian, LLP

(57) ABSTRACT

In an apparatus for detecting condition of load connected to a general-purpose internal combustion engine, a first threshold value is compared with a sum obtained by adding a predetermined value to a detected throttle opening and changes the threshold value to the sum if the first threshold value is less than the sum and the engine is determined to be under first load condition if the throttle opening exceeds the threshold value. Next a second threshold value is compared with a difference obtained by subtracting change amounts of the engine speed and throttle opening and the engine is determined to be under second load condition if the difference exceeds the second threshold value, thereby enabling to accurately detect a condition of a load connected to the engine. Then the desired engine speed is changed in response to results of the determinations.

8 Claims, 4 Drawing Sheets

LOAD CONDITION DETECTION APPARATUS FOR GENERAL-PURPOSE ENGINE

BACKGROUND OF THE INVENTION

1. Field of the Invention

This invention relates to a load condition detection apparatus for a general-purpose internal combustion engine, particularly to an apparatus for detecting a condition of a load such as an operating machine, etc, which is connected to the general-purpose engine and consumes power of the engine.

2. Description of the Related Art

Generally, a general-purpose internal combustion engine is connected to a load such as an operating machine and outputs power to be supplied thereto. When the engine experiences no load condition where the load does not consume the power, if left as it is, it is disadvantageous in noise and fuel consumption. In order to solve the problem, there has been proposed a technique to detect no load condition and decrease the engine speed, as taught, for example, in Japanese Laid-Open Patent Application No. 2005-299519.

In the reference, the engine is connected to a pump of a high-pressure washing machine to operate the pump to discharge water through a washing gun. Water discharge, i.e., the load condition of the pump, is detected by comparing a detected throttle opening to a throttle opening (threshold value) set to increase with increasing engine speed.

SUMMARY OF THE INVENTION

In the prior art a value determined based on the engine speed is used as the threshold value to be compared to the throttle opening. The threshold value is sometimes set to a relatively large value taking changes in the engine operating condition or environment into account and with such the threshold value, it is likely to determine to be no load condition if a small load is imparted.

In other words, it is difficult in the prior art to accurately detect the load condition of the engine where the load consumes the engine output. Further, it is sometimes difficult to accurately detect the load condition simply by comparing the throttle opening to the threshold value.

An object of this invention is therefore to overcome the foregoing problems by providing a load condition detection apparatus for a general-purpose engine that can accurately detect a condition of a load connected to the engine.

In order to achieve the object, this invention provides in its first aspect an apparatus for detecting condition of load connected to a general-purpose internal combustion engine equipped with an electronic governor having an actuator that moves a throttle value installed in an air intake passage to regulate a speed of the engine, comprising: a throttle opening detector that detects an opening of the throttle valve; an engine speed detector that detects the engine speed; a desired engine speed convergence determiner that determines whether the detected engine speed converges to a desired engine speed; a threshold value changer that compares a first threshold value with a sum obtained by adding a predetermined value to the detected throttle opening and changes the threshold value to the sum if the first threshold value is less than the sum, when it is determined that the detected engine speed converges to the desired engine speed; a first load condition determiner which determines that the engine is under first load condition where the load consumes power generated by the engine when the throttle opening exceeds the first threshold value; a second load condition determiner which compares a second threshold value with a difference obtained by subtracting a change amount of the engine speed per a unit time from a change amount of the throttle opening per the unit time, and determines that the engine is under second load condition where the load consumes the power generated by the engine when the difference exceeds the second threshold value; and a desired engine speed changer that changes the desired engine speed in response to results of determination of the first load condition determiner and the second load condition determiner.

In order to achieve the object, this invention provides in its second aspect a method of detecting condition of load connected to a general-purpose internal combustion engine equipped with an electronic governor having an actuator that moves a throttle value installed in an air intake passage to regulate a speed of the engine, comprising the steps of: detecting an opening of the throttle valve; detecting the engine speed; determining whether the detected engine speed converges to a desired engine speed; comparing a first threshold value with a sum obtained by adding a predetermined value to the detected throttle opening and changing the threshold value to the sum if the first threshold value is less than the sum, when it is determined that the detected engine speed converges to the desired engine speed; determining that the engine is under first load condition where the load consumes power generated by the engine when the throttle opening exceeds the first threshold value; comparing a second threshold value with a difference obtained by subtracting a change amount of the engine speed per a unit time from a change amount of the throttle opening per the unit time, and determining that the engine is under second load condition where the load consumes the power generated by the engine when the difference exceeds the second threshold value; and changing the desired engine speed in response to results of determination of the first load condition determiner and the second load condition determiner.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

A load condition detection apparatus for a general-purpose engine according to a preferred embodiment of the present invention will now be explained with reference to the attached drawings.

Figure 1:
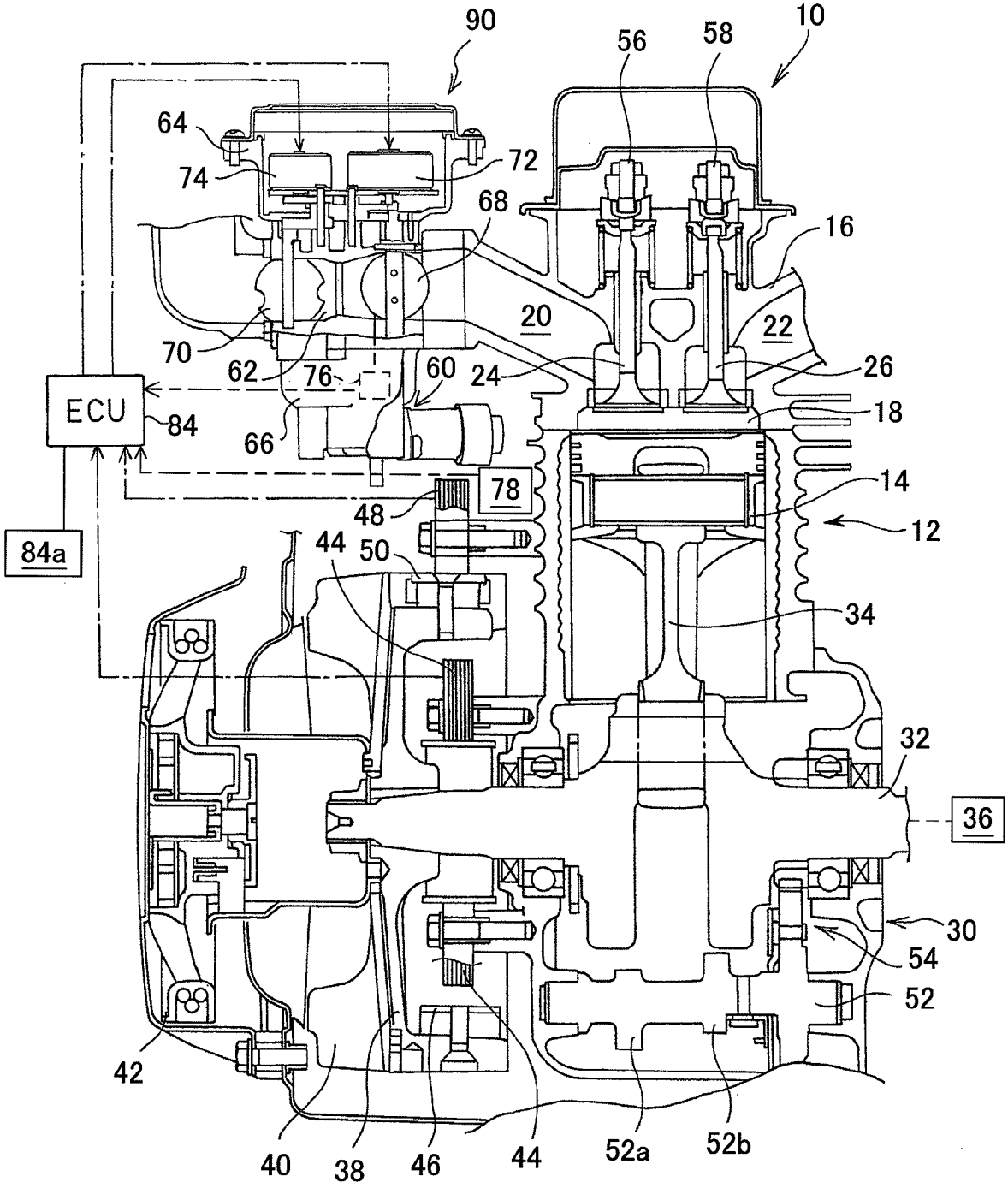
FIG. 1 is an overall schematic view of a load condition detection apparatus for a general-purpose engine according to an embodiment of this invention.

FIG. 1 is an overall schematic view of a load condition detection apparatus for a general-purpose engine according to an embodiment of this invention.

In FIG. 1, reference numeral 10 designates a general-purpose internal combustion engine (hereinafter referred to as "engine"). The engine 10 is a single-cylinder, air-cooled, four-cycle, OHV engine with a displacement of, for example, 440 cc.

A cylinder formed in a cylinder block 12 of the engine 10 accommodates a piston 14 that reciprocates therein. As illustrated, a cylinder head 16 is attached to the top of the cylinder block 12. The cylinder head 16 is formed with a combustion chamber 18 facing the crown of the piston 14, and provided with an intake port 20 and exhaust port 22 that communicate with the combustion chamber 18. An intake valve 24 and exhaust valve 26 are installed near the intake port 20 and exhaust port 22, respectively.

A crankcase 30 is attached to the bottom of the cylinder block 12 and houses a crankshaft 32 to be rotatable therein. The crankshaft 32 is connected to the bottom of the piston 14 through a connecting rod 34. One end of the crankshaft 32 is connected with a load 36 so that the engine 10 supplies power to the load 36.

Generally a term "load" means a machine or equipment that is connected to a prime mover and consumes power or energy (output) supplied from the prime mover, or the magnitude of power (or power work done per unit time) consumed by the machine. In this embodiment the load 36 is used as the former meaning, precisely an operating machine such as a high-pressure washing machine, snowplow or other devices.

Accordingly, in this embodiment, a phrase that the engine 10 is "under load condition" indicates a condition where the load 36 consumes power generated by the engine 10 and a phrase that the engine 10 is "under no load condition" a condition where the load 36 does not consume power generated by the engine 10.

The other end of the crankshaft 32 is attached with a flywheel 38, cooling fan 40 and recoil starter 42 used for engine start. A power coil (generator coil) 44 is attached to the crank case 30 in the inside of the flywheel 38 and magnets (permanent magnet pieces) 46 are attached on a back surface of the flywheel 38. The power coil 44 and magnets 46 constitute a multipolar generator that produces electric power in synchronization with rotation of the crankshaft 32.

An exciter coil 48 is attached to the crank case 30 in the outside of the flywheel 38 and magnets (permanent magnet pieces) 50 are attached on a top surface of the flywheel 38. The exciter coil 48 produces an output every time the magnet 50 passes.

A camshaft 52 is rotatably housed in the crank case 30 to be parallel with the axis line of the crankshaft 32 and connected via a gear mechanism 54 to the crankshaft 32 to be driven thereby. The camshaft 52 is equipped with an intake cam 52*a* and exhaust cam 52*b* to operate the intake valve 24 and exhaust valve 26 through a push rod (not shown) and rocker arms 56, 58.

A carburetor 60 is connected to the intake port 20. The carburetor 60 unitarily comprises an air intake passage 62, motor case 64 and carburetor assembly 66. The air intake passage 62 is installed with a throttle valve 68 and choke valve 70.

The motor case 64 houses an electric throttle motor (actuator) 72 for operating the throttle valve 68 and an electric choke motor (actuator) 74 for operating the choke valve 70. The throttle and choke motors 72, 74 comprise stepper motors.

The carburetor assembly 66 is supplied with fuel from a fuel tank (not shown) to produce air-fuel mixture by injecting fuel by an amount defined by the opening of the throttle valve 68 (and choke valve 70) to be mixed with intake air flowing through the air intake passage 62.

The produced air-fuel mixture passes through the intake port 20 and intake valve 24 to be sucked into the combustion chamber 18 and is ignited by an ignitor to burn. The resulting combustion gas (exhaust gas) is discharged to the exterior of the engine 10 through the exhaust valve 26, exhaust port 22, a muffler (not shown), etc.

A throttle opening sensor 76 installed near the throttle valve 68 produces an output or signal corresponding to the opening of the throttle valve 68, i.e., throttle opening. A temperature sensor 78 having a thermistor, etc., is installed at an appropriate position of the cylinder block 12 and produces an output or signal indicative of the temperature of the engine 10.

The outputs of the throttle opening sensor 76 and temperature sensor 78 and also outputs of the power coil 44 and exciter coil 48 are sent to an electronic control unit (ECU) 84. The ECU 84 includes a microcomputer having a CPU, ROM, memory, input/output circuits and other devices, and a warning lamp 84*a*.

The output (alternating current) of the power coil 44 is sent to a bridge circuit (not shown) in the ECU 84, where it is converted to direct current through full-wave rectification to be supplied as operating power to the ECU 84, throttle motor 72 and the like, and also sent to a pulse generation circuit (not shown), where it is converted to a pulse signal. The output of the exciter coil 48 is used as an ignition signal of the ignitor.

The CPU of the ECU 84 detects the engine speed based on the converted pulse signal and controls the operations of the throttle motor 72 and choke motor 74 based on the detected engine speed and the outputs of the throttle opening sensor 76 and temperature sensor 78, while controlling the ignition through the ignitor.

Thus the engine 10 includes an electronic governor 90 that regulates the engine speed by using the actuator or throttle motor 72 which operates the throttle valve 68 in the air intake passage 62.

The CPU of the ECU 84 also detects whether the engine 10 is under load condition where the connected load 36 such as an operating machine consumes power generated by the engine 10.

Figure 2:
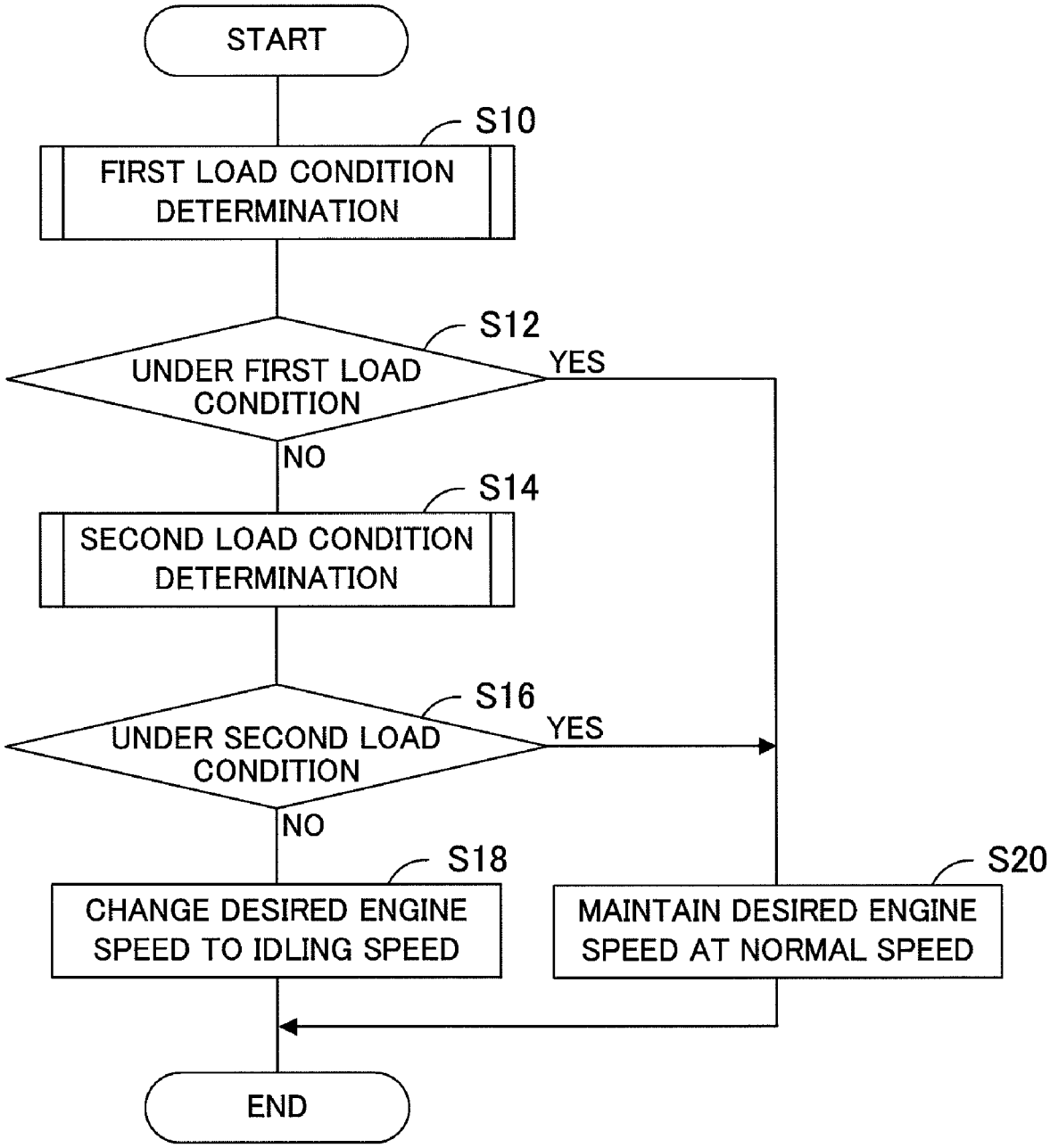
FIG. 2 is a flowchart showing the operation of the apparatus shown in FIG. 1.

FIG. 2 is a flowchart showing the determination operation. The illustrated program is executed by the ECU 84 at predetermined interval, e.g., 10 milliseconds.

The program starts at S10, in which a first load condition determination process is conducted.

Figure 3:
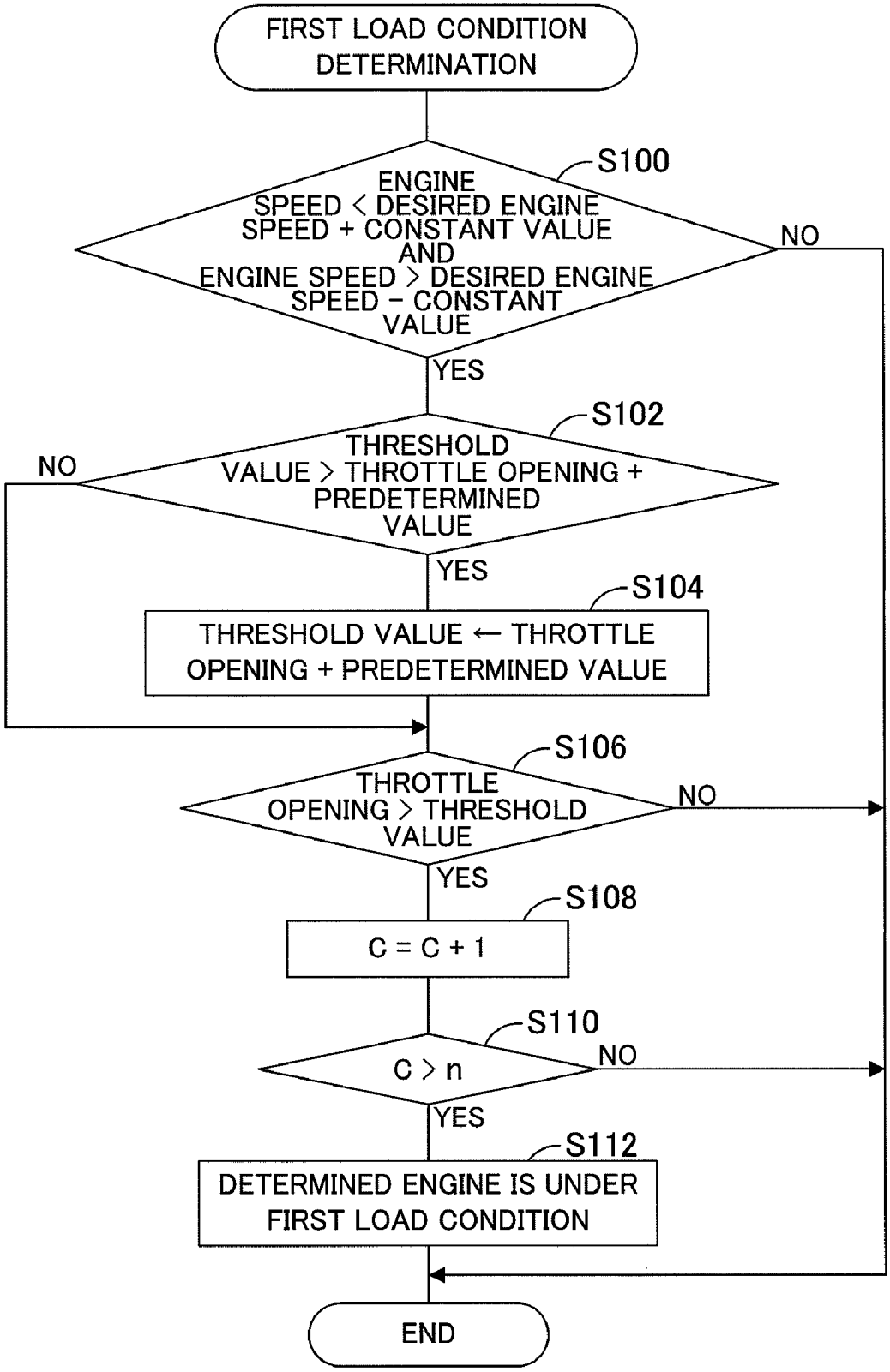
FIG. 3 is a subroutine flowchart showing a first load condition determination process shown in FIG. 2.

FIG. 3 is a subroutine flowchart showing the process.

In S100, it is determined whether the detected engine speed is less than a value obtained by adding a constant value to a desired engine speed, but is greater than a value obtained by subtracting the constant value from the desired engine speed. In other words, it is determined whether the detected engine speed converges to the desired engine speed.

The desired engine speed is a speed determined in accordance with the load 36, i.e., a type or nature of the load 36. The constant value is set to a small value of, e.g., 100 to 200 rpm. The processing of S100 is done for determining whether the engine 10 is stably rotated in a normal speed range which is determined depending on the type of the load 36.

When the result in S100 is negative, the remaining steps are skipped and when the result is affirmative, the program proceeds to S102, in which it is determined whether a threshold value is greater than a value (opening) obtained by adding a predetermined value to the detected throttle opening. The initial threshold value is set to an appropriate value and the predetermined value is a value corresponding to throttle opening of 3 degrees or thereabout.

When the result in S102 is affirmative, the program proceeds to S104, in which the threshold value is changed (set) to the value obtained by adding the predetermined value to the detected throttle opening. When the result is negative, the step of S104 is skipped.

The program then proceeds to S106, in which it is determined whether the detected throttle opening is greater than the threshold value changed (set) in S104. When the result is negative, the remaining steps are skipped. If the program proceeded to S104, the result in S106 is naturally negative.

When the result in S106 is affirmative, the program proceeds to S108, in which a counter value C is incremented by 1. Specifically, the value C of a counter which counts the number of times that the throttle opening is determined to exceed the threshold value in S106 is incremented by 1.

The program then proceeds to S110, in which it is determined whether the counter value C is greater than a prescribed value n (e.g., 50). Since this subroutine flowchart of FIG. 3 is executed at predetermined intervals, the processing of S110 amounts to determining whether a predetermined time period (e.g., 0.5 second) corresponding to the prescribed value n has elapsed.

When the result in S110 is negative, the remaining steps are skipped, while, when the result is affirmative, the program proceeds to S112, in which it is determined that the engine 10 is under load condition (more precisely first load condition) where the load 36 consumes power generated by the engine 10, and the bit of a control flag is set to 1. The reason why this determination is made after the elapse of the predetermined time period is to avoid misjudgment due to temporal noise of detected throttle opening.

Returning to the explanation of FIG. 2 flowchart, the program proceeds to S12, in which it is determined whether the engine 10 is under first load condition. When the program in the FIG. 3 subroutine flowchart has not proceeded to S112, the result in S12 is negative and the program proceeds to S14, in which a second load condition determination process is conducted.

Figure 4:
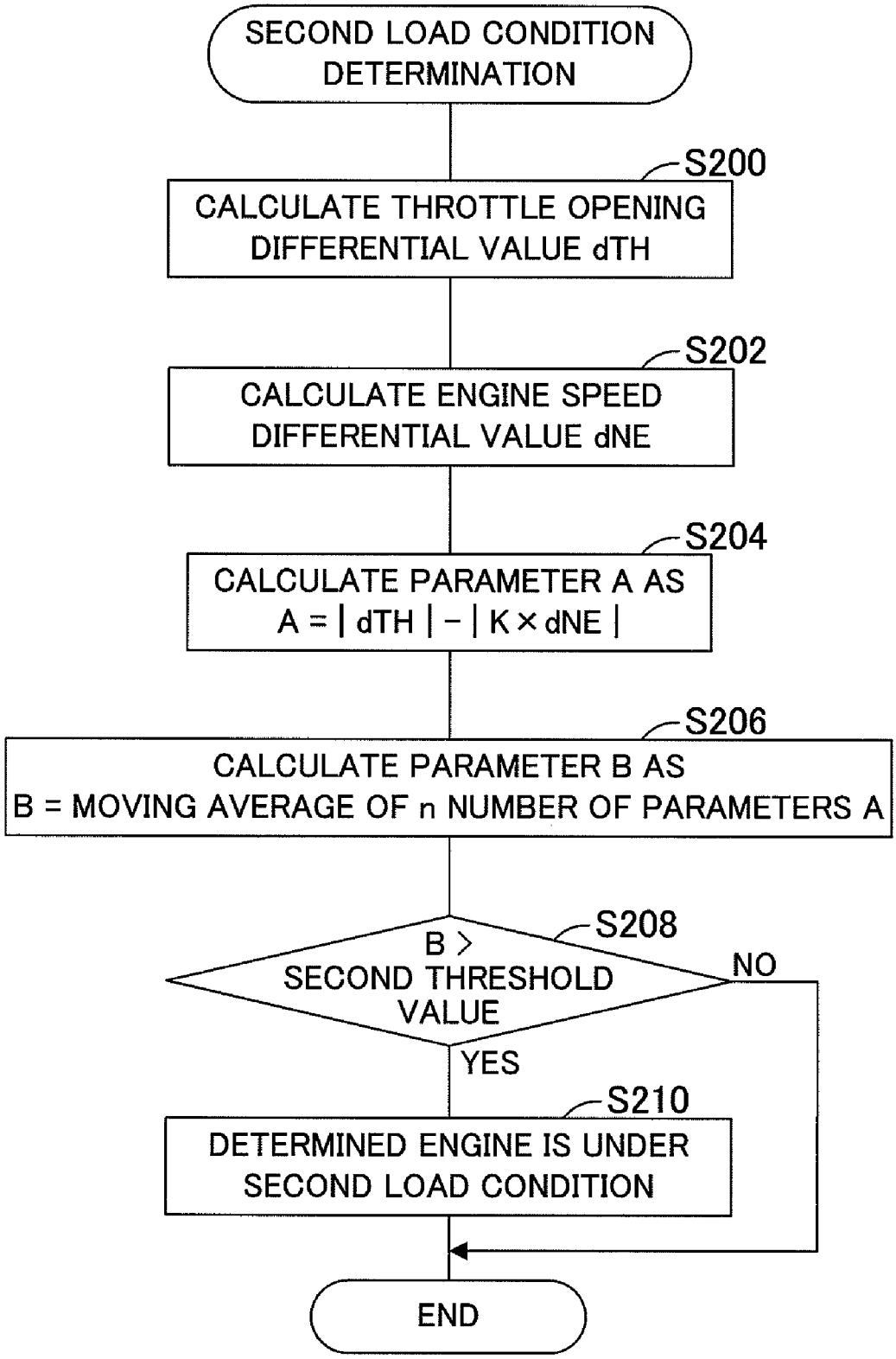
FIG. 4 is a subroutine flowchart showing a second load condition determination process shown in FIG. 2.

FIG. 4 is a subroutine flowchart showing the process.

In S200, a differential value (a change amount per a unit time) dTH of the throttle opening is calculated. Specifically, a preceding value of the throttle opening is stored in memory and a difference between the current and preceding values is calculated as the differential value dTH.

The program then proceeds to S202, in which a differential value (a change amount per the unit time) dNE of the engine speed is calculated. Similarly, a preceding value of the engine speed is stored in memory and a difference between the current and preceding values is calculated as the differential value dNE.

The program then proceeds to S204, in which a parameter A is calculated. The parameter A is calculated by multiplying the engine speed differential value dNE by a gain K and by subtracting an absolute value of the product from an absolute value of the throttle opening differential value dTH. The gain K is an appropriate small value, e.g., 0.001.

When the engine 10 is under no load condition, since a rotational inertia force of the crankshaft 32 is small, the engine speed sharply changes with respect to the change of the throttle opening. In contrast, when the engine 10 is under load condition, the rotational inertia force is large so that the engine speed slowly changes with respect to the throttle opening change. Consequently, the parameter A calculated under no load condition becomes small, while under load condition becomes large.

The program next proceeds to S206, in which a parameter B indicating a moving average of n number of parameters A is calculated. The number n is set to an appropriate value, e.g., 16.

The program then proceeds to S208, in which the parameter B is compared to a second threshold value. When the parameter B exceeds the second threshold value, the result is affirmative and the program proceeds to S210, in which it is determined that the engine 10 is under load condition (more precisely under second load condition), and the bit of a control flag is set to 1. When the result in S208 is negative, this subroutine program is terminated.

The reason why the parameter B comprising the moving average of n number of parameters A is used for comparison to the second threshold value in S208 is also to avoid misjudgment due to temporal noise of detected throttle opening and engine speed.

The explanation on FIG. 2 will be resumed. The program proceeds to S16, in which it is determined whether the engine 10 is under load condition (more precisely under second load condition).

When the program in the FIG. 4 subroutine flowchart has not experienced the processing in S210, the result in S16 is negative and the program proceeds to S18, in which the desired engine speed is changed (set) to the idling speed, since it is determined that the engine 10 is neither under first load condition nor under second load condition.

On the other hand, when the result in S12 or S16 is affirmative, in other words when it is determined that the engine 10 is under first and second load condition, the program proceeds to S20, in which the desired engine speed is maintained at (or changed to, if not) the speed (normal speed) determined in accordance with the type of the load 36.

As stated above, the embodiment is configured to have an apparatus for and a method of detecting condition of load connected to a general-purpose internal combustion engine (10) equipped with an electronic governor (90) having an actuator (electric throttle motor 72) that moves a throttle value (68) installed in an air intake passage (62) to regulate a speed of the engine, comprising: a throttle opening detector (throttle opening sensor 76, ECU 84) that detects an opening of the throttle valve; an engine speed detector (power coil 44, ECU 84) that detects the engine speed; a desired engine speed convergence determiner (ECU 84, S10, S100) that determines whether the detected engine speed converges to a desired engine speed; a threshold value changer (ECU 84, S10, S102, S104) that compares a first threshold value with a sum obtained by adding a predetermined value to the detected throttle opening and changes the threshold value to the sum if the first threshold value is less than the sum, when it is determined that the detected engine speed converges to the desired engine speed; a first load condition determiner (ECU 84, S10, S106-S112) which determines that the engine is under first load condition where the load consumes power generated by the engine when the throttle opening exceeds the first threshold value; the counted number of times exceeds a prescribed value; a second load condition determiner (ECU 84, S14, S200-S210) which compares a second threshold value with a difference obtained by subtracting a change amount of the engine speed per a unit time from a change amount of the throttle opening per the unit time, and determines that the engine is under second load condition where the load consumes the power generated by the engine when the difference exceeds the second threshold value; and a desired engine speed changer (ECU 84, S18, S20) that changes the desired engine speed in response to results of determination of the first load condition determiner and the second load condition determiner.

Owing to this configuration, a condition of the load can be accurately determined. Specifically, since the throttle opening when the engine is stably operated in the normal speed range is detected or specified and the threshold value is newly set with a value obtained by adding the predetermined value to the specified throttle opening, the threshold value can be appropriately set, thereby enabling to accurately determine whether the engine 10 is under the load condition.

Further, in addition to the first load condition determination, the second load condition determination is adapted to compare the parameter A obtained by subtracting the engine speed differential value dNE from the throttle opening differential value dTH (more exactly, the parameter B indicating the moving average of n number of parameters A) to the second threshold value, and determine that it is in the load condition when the parameter exceeds the second threshold value. With this, a condition of the load can be further accurately determined.

Further, the desired engine speed changer (ECU 84, S18, S20) changes the desired engine speed in response to results of determination of the first load condition determiner and the second load condition determiner, it becomes possible to operate the engine 10 more appropriately.

Specifically, in the apparatus and method, the desired engine speed changer changes the desired engine speed to a normal engine speed determined by nature of the load when the engine is determined to be under the first load condition and the second load condition (S20).

In the apparatus and method, the desired engine speed changer changes the desired engine speed to an idling speed when the engine is determined to be neither under the first load condition nor under the second load condition (S18).

The apparatus and method further includes: a counter (S106, S108) that counts a number of times that the throttle opening exceeds the first threshold value; and the first load condition determiner determines that the engine is under the first load condition when the counted number of times (C) exceeds a prescribed value (n) (S112).

It should be noted that, although the constant value, predetermined value, etc., are indicated with specific values in the foregoing, they are only examples and not limited thereto.

Although, when the result in S16 is negative, i.e., when it is determined that the engine 10 is not under load condition, the desired engine speed is set with the idling speed in S18, the warning lamp 84*a* may be lit instead to inform the operator. Any other audible or visible device can also be applied.

Japanese Patent Application No. 2009-107979 filed on Apr. 27, 2009, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for detecting condition of load connectable to a general-purpose internal combustion engine equipped with an electronic governor having an actuator that moves a throttle value installed in an air intake passage to regulate a speed of the engine, comprising:

a throttle opening detector that detects an opening of the throttle valve;

an engine speed detector that detects the engine speed;

a desired engine speed convergence determiner that determines whether the detected engine speed converges to a desired engine speed;

a threshold value changer that compares a first threshold value with a sum obtained by adding a predetermined value to the detected throttle opening and changes the threshold value to the sum if the first threshold value is less than the sum, when it is determined that the detected engine speed converges to the desired engine speed;

a first load condition determiner which determines that the engine is under first load condition where the load consumes power generated by the engine when the throttle opening exceeds the first threshold value;

a second load condition determiner which compares a second threshold value with a difference obtained by subtracting a change amount of the engine speed per a unit time from a change amount of the throttle opening per the unit time, and determines that the engine is under second load condition where the load consumes the power generated by the engine when the difference exceeds the second threshold value; and a desired engine speed changer that changes the desired engine speed in response to results of determination of the first load condition determiner and the second load condition determiner.

2. The apparatus according to claim 1, wherein the desired engine speed changer changes the desired engine speed to a normal engine speed determined by nature of the load when the engine is determined to be under the first load condition and the second load condition.

3. The apparatus according to claim 1, wherein the desired engine speed changer changes the desired engine speed to an idling speed when the engine is determined to be neither under the first load condition nor under the second load condition.

4. The apparatus according to claim 1, further including:

a counter that counts a number of times that the throttle opening exceeds the first threshold value;

and the first load condition determiner determines that the engine is under the first load condition when the counted number of times exceeds a prescribed value.

5. A method of detecting condition of load connectable to a general-purpose internal combustion engine equipped with an electronic governor having an actuator that moves a throttle value installed in an air intake passage to regulate a speed of the engine, comprising the steps of:

detecting an opening of the throttle valve;

detecting the engine speed;

determining whether the detected engine speed converges to a desired engine speed;

comparing a first threshold value with a sum obtained by adding a predetermined value to the detected throttle opening and changing the threshold value to the sum if the first threshold value is less than the sum, when it is determined that the detected engine speed converges to the desired engine speed;

counting a number of times that the throttle opening exceeds the first threshold value;

determining that the engine is under first load condition where the load consumes power generated by the engine when the counted number of times exceeds a prescribed value;

comparing a second threshold value with a difference obtained by subtracting a change amount of the engine speed per a unit time from a change amount of the throttle opening per the unit time, and determining that the engine is under second load condition where the load consumes the power generated by the engine when the difference exceeds the second threshold value; and changing the desired engine speed in response to results of determination of the first load condition determiner and the second load condition determiner.

6. The method according to claim 5, wherein step of the desired engine speed changing changes the desired engine speed to a normal engine speed determined by nature of the load when the engine is determined to be under the first load condition and the second load condition.

7. The method according to claim 5, wherein the step of desired engine speed changing changes the desired engine speed to an idling speed when the engine is determined to be neither under the first load condition nor under the second load condition.

8. The method according to claim 5, further including the step of:

counting a number of times that the throttle opening exceeds the first threshold value;

and the step of first load condition determining determines that the engine is under the first load condition when the counted number of times exceeds a prescribed value.

* * * * *